US012187562B2

(12) United States Patent
Ronnila et al.

(10) Patent No.: US 12,187,562 B2
(45) **Date of Patent: *Jan. 7, 2025**

(54) CHUCK WITH IMPROVED TORQUE TRANSMISSION AND CENTRALIZATION

(71) Applicant: Sonoco Development, Inc., Hartsville, SC (US)

(72) Inventors: Markku Ronnila, Lahti (FI); Ismo Kervinen, Kotka (FI); Andrei Klimenko, Lohja (FI)

(73) Assignee: Sonoco Development, Inc., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/502,900

(22) Filed: Nov. 6, 2023

(65) Prior Publication Data

US 2024/0067479 A1 Feb. 29, 2024

Related U.S. Application Data

(63) Continuation of application No. 17/110,970, filed on Dec. 3, 2020, now Pat. No. 11,807,477.

(51) Int. Cl.

| | |
|---|---|
| ***B65H 18/10*** | (2006.01) |
| ***B65H 16/02*** | (2006.01) |
| ***B65H 16/10*** | (2006.01) |
| ***B65H 18/02*** | (2006.01) |

(52) U.S. Cl.

CPC ..... *B65H 18/10* (2013.01); *B65H 16/02* (2013.01); *B65H 16/103* (2013.01); *B65H 18/02* (2013.01); *B65H 2301/41461* (2013.01); *B65H 2403/72* (2013.01)

(58) Field of Classification Search

None

See application file for complete search history.

(56) References Cited

U.S. PATENT DOCUMENTS

| | | | |
|---|---|---|---|
| 2,280,370 | A | 4/1942 | Bennett |
| 3,097,808 | A | 7/1963 | Williams |
| 3,157,405 | A | 11/1964 | Hafemeister |
| 3,610,643 | A | 10/1971 | Thompson |
| 3,791,659 | A | 2/1974 | Hardin |
| 3,881,666 | A | 5/1975 | Greenhalgh |
| 4,148,444 | A | 4/1979 | Hehner |
| 4,149,682 | A | 4/1979 | Gustafson et al. |

(Continued)

FOREIGN PATENT DOCUMENTS

| | | | |
|---|---|---|---|
| DE | 1813813 | A1 | 9/1970 |
| KR | 1020000076690 | A | 12/2000 |

OTHER PUBLICATIONS

International Search Report and Written Opinion related to Application No. PCT/US2021/054483 reported on Feb. 4, 2022.

(Continued)

*Primary Examiner* — William A. Rivera

(74) *Attorney, Agent, or Firm* — von Briesen & Roper, s.c.

(57) ABSTRACT

An expansible chuck for holding hollow cylindrical cores used for winding and unwinding sheet material. A portion of the chuck body nearest the flange is stepped up so that the diameter of the chuck near the flange is slightly larger than the diameter of the rest of the chuck. The stepped up portion centers the chuck within the core which helps the expanding elements to uniformly grip the core.

20 Claims, 4 Drawing Sheets

(56) References Cited

U.S. PATENT DOCUMENTS

| | | | | |
|---|---|---|---|---|
| 4,391,451 | A | 7/1983 | Secor et al. | |
| 4,465,244 | A | 8/1984 | Karr | |
| 4,730,779 | A | 3/1988 | Thievessen | |
| 5,123,605 | A | 6/1992 | Hehner et al. | |
| 5,490,640 | A | 2/1996 | Miller et al. | |
| 5,934,605 | A | 8/1999 | Marin | |
| 11,534,839 | B2 | 12/2022 | Bartolone | |
| 11,807,477 | B2 * | 11/2023 | Ronnila ..... | B65H 18/10 |
| 2001/0035475 | A1 | 11/2001 | Van Deurse | |
| 2005/0224627 | A1 | 10/2005 | Stolyar et al. | |

OTHER PUBLICATIONS

Goldenrod Corporation, "Model 1480-LFTX Torque Chuck", Setting the Gold Standard, Goldenrod Corporation, Beacon Falls, Connecticut.

* cited by examiner

CHUCK WITH IMPROVED TORQUE TRANSMISSION AND CENTRALIZATION

BACKGROUND OF THE INVENTION

Field of the Invention

This disclosure relates to an expansible chuck for holding hollow cores used for winding and unwinding sheet material. More particularly, this disclosure relates to an expansible chuck having a stepped portion for centering the chuck within the core and improving torque transmission between the expanding elements and the core.

Description of the Related Art

Web materials such as polymer film, paper and textiles are used to manufacture a variety of products. These web materials may be provided in the form of large rolls formed by winding the web material about a paperboard winding core.

During a winding or unwinding operation, the paperboard core is typically mounted on rotating expansible chucks that are inserted into the ends of the core and expanded to grip the inside of the core. Typically, the rotation of the core is achieved by means of a drive coupled to one or both of the chucks.

The clearance (distance) between the inner surface of the core and the chuck body must be large enough to allow insertion of the chuck, even when the inner surface of the core is not perfectly round. For example, in a nominal 76 mm (3 in) ID core, the clearance typically is about 0.3 mm. In a nominal 6 in ID core the clearance is about 0.5 mm.

If the clearance is too large, the chuck may not be properly centered within the core and the expanding elements (jaws) may not uniformly grip the core. This can cause slippage of the core with respect to the chucks during winding or unwinding operations.

The present disclosure is designed to solve the problems described above.

BRIEF SUMMARY OF THE INVENTION

The present disclosure relates to an expansible chuck for holding hollow cylindrical cores used for winding and unwinding sheet material. A portion of the chuck body (nearest the flange) is stepped up so that the diameter of the chuck near the flange is slightly larger than the diameter of the rest of the chuck. The stepped up portion centers the chuck within the core which helps the expanding elements (jaws) to uniformly grip the core, preventing slippage of the core with respect to the chucks during winding or unwinding operations.

In an embodiment, the chuck comprises a flange, a body and a plurality of expansion elements. The hollow cylindrical core has an inner diameter (ID) and an outer diameter (OD). The chuck defines an axis (A). The flange is adapted to attach the chuck to a rotating (rotatable) support. The body extends axially from the flange, and comprises one or more stepped portions near the flange and a distal portion farther away from the flange. The distal portion has a constant diameter that is less than the core inner diameter (ID). The distal portion and the core define a gap (or clearance) therebetween when the core is mounted onto the chuck. The body may define a plurality of recesses. The plurality of expansion elements are circumferentially disposed around the chuck and adapted to grip an inner surface of the core. Each expansion element is nested within one of the recesses.

The one or more stepped portions have a diameter (D1) slightly larger than the diameter (D2) of the distal portion, and are configured to contact the core inner surface and center the chuck inside the core when the core is mounted onto the chuck.

In one embodiment the one or more stepped portions have an axial length equal to or less than 30 mm but preferably less than 20 mm to allow easy insertion into the core. The diameter (D1) of the one or more stepped portions may be equal to, less than or greater than the inner diameter (ID) of the core.

Each of the expansion elements has a core contacting surface. The expansion elements are moveable between an unexpanded position in which each of the expansion elements is disposed within one of the plurality of recesses and an expanded position in which each of the expansion elements is positioned radially outward of its unexpanded position and in which the core contacting surface contacts the inner surface of the core. The expansion elements may move from the unexpanded position to the expanded position as a result of an application of torque or other force on the expansion elements.

This disclosure also relates to a method of holding a hollow core while centering the chucks within the core. A pair of chucks, each having expansion elements and a stepped portion or portions may be attached to rotating supports. While the expansion elements are in their unexpanded position, each chuck is inserted into an end of the core until the one or more stepped portions contact the core inner surface, thereby centering the chucks with respect to the core.

This disclosure also relates to a method of centering a chuck within a hollow core by attaching the chuck to a support and then inserting the chuck into an end of the core until the one or more stepped portions contact the core inner surface. The chuck should be inserted into the end of the core while the expansion elements are in their unexpanded position.

DETAILED DESCRIPTION OF THE INVENTION

Figure 1:
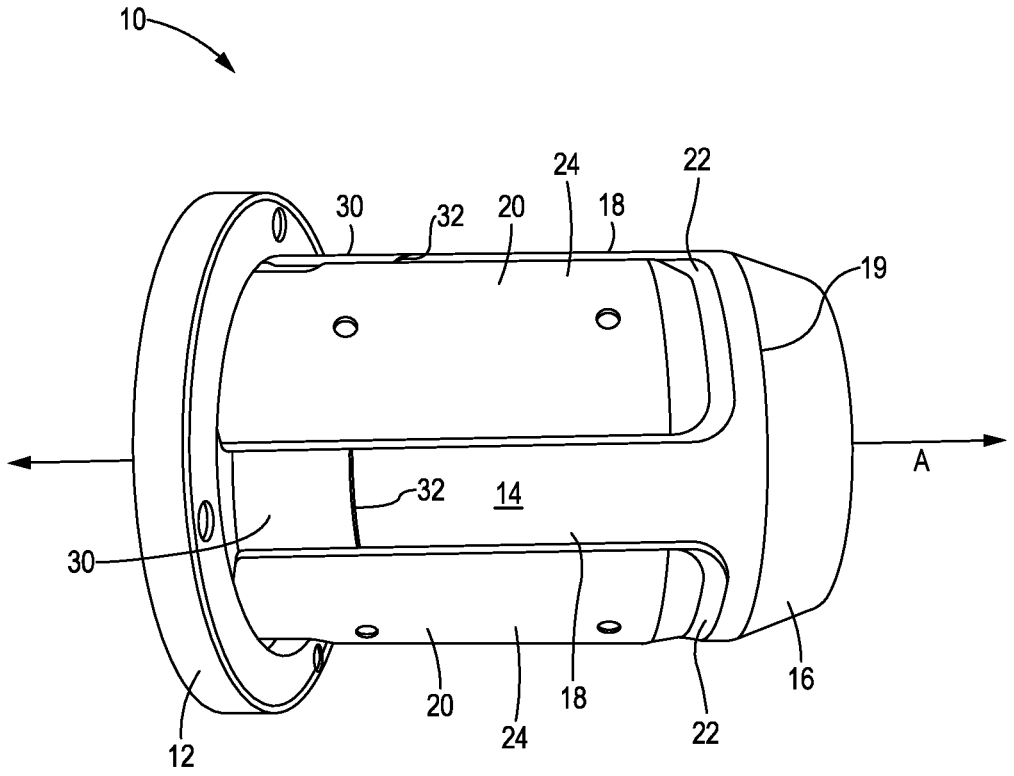
FIG. 1 is a side perspective view of a chuck according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

The present disclosure is directed to a chuck in which one or more portions of the chuck body (nearest the flange) are stepped up so that the diameter of the chuck at the stepped portions (near the flange) is slightly larger than the diameter of the portion of the chuck farther away from the flange. An exemplary chuck 10 having stepped portions 30 is shown in FIG. 1. The chuck 10 is of the expansible variety and may comprise a flange 12, a body 14, an end cap 16 and expansion elements or jaws 20.

The flange 12 may be adapted to attach the chuck 10 to a spindle, shaft or other rotating support. The flange 12 may be generally cylindrical. Alternatively, the chuck 10 may comprise a base (not shown in FIG. 1) located between the flange 12 and the body 14.

The body 14 extends axially outward from the flange 12 and comprises a stepped portion or portions 30 near the flange 12 and a distal portion 18 farther away from the flange 12. The distal portion 18 has a constant diameter which is slightly less than the core inner diameter (ID).

The end cap 16 may be tapered to facilitate easier mounting of the core 50 (not shown) onto the chuck 10.

The jaws 20 are housed within recesses 22 defined by the body 14 and are circumferentially disposed around the chuck 10. The jaws 20 move radially outward with respect to the body 14 in order to grip the inner surface 52 of a core 50. The radially outward movement of the jaws 20 can be torque activated or activated by other means such as hydraulics, pneumatics and axial load expansion.

Stepped Portions 30

The chuck body 14 further comprises one or more stepped portions 30. The stepped portions 30 are located near the flange 12. The stepped portions 30 may comprise individual segments or steps as shown in FIG. 1. Preferably the stepped portions 30 collectively define a circular cylinder having a diameter D1.

Figure 2:
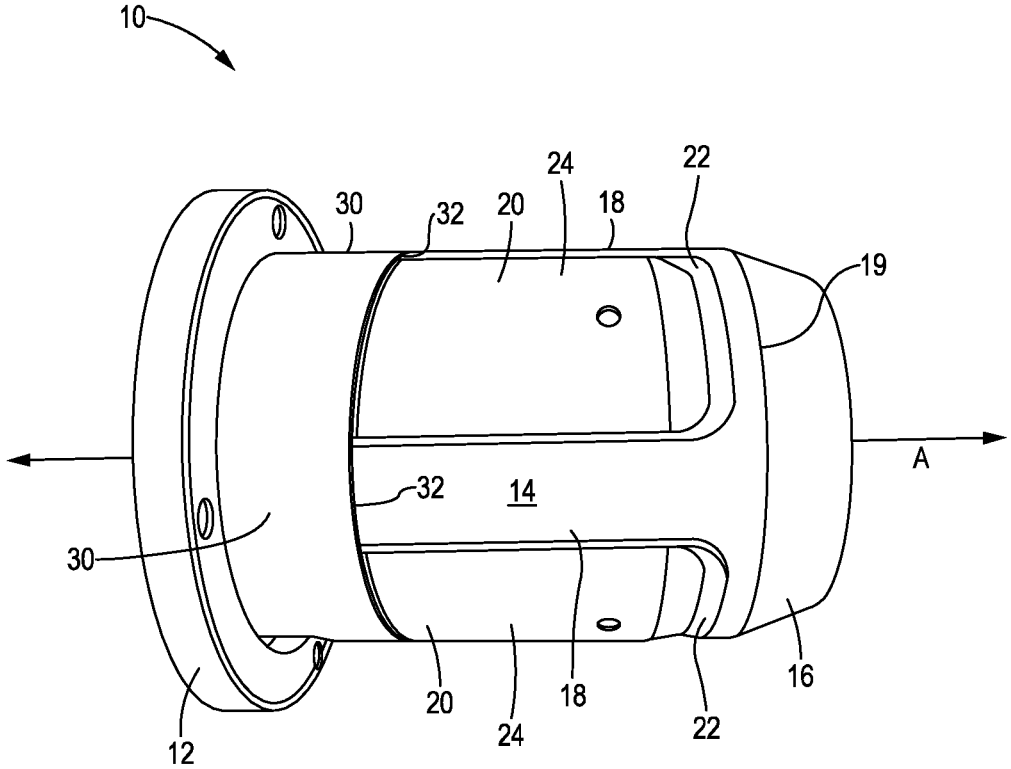
FIG. 2 is a side perspective view of another embodiment of a chuck according to the disclosure.

Alternatively, as shown in FIG. 2, the stepped portion 30 may comprise a single continuous structure extending circumferentially around the entire chuck 10. The leading edge 32 of the stepped portion 30 may be tapered.

The stepped up portion (or "stepped portion" as it will be referred to herein) is configured to contact the core inner surface 52 to help center the chuck within the core 50 so that the expansion elements 20, when expanded, can more uniformly grip (and transfer torque to) the inner surface 52 of the core 50.

Diameter of Stepped Portion

The stepped portion 30 has a diameter (D1) slightly larger than the diameter (D2) of the distal portion 18. At the same time, the diameter (D1) of the stepped portion 30 may be equal to, slightly less or slightly greater than the nominal inner diameter (ID) of the core 50 for which the chuck 10 will be used.

Axial Length of Stepped Portion

The axial length (in the direction of axis A in FIG. 1) of the stepped portion 30 may be any suitable length, for example, 30 mm, and preferably is 20 mm or less to minimize any difficulty inserting or withdrawing the chuck 10 from the core 50. In other words, preferably the diameter (D1) of the last 20 mm or so of the chuck body 14 near the flange 12 is stepped up. This is especially important where the inner surface 52 of the core 50 is irregular shaped (non-round).

The inner surface 52 of the core 50 sometimes can become distorted so that it is not perfectly round (cylindrical). This distortion can make it difficult to insert or withdraw the chucks 10 from the core 50 because of the large amount of friction or interference between the chuck and core 50 at the stepped portion 30. Minimizing the axial length of the steps alleviates this problem.

If the axial length of the stepped portion 30 is short enough, significantly less than 20 mm, the diameter (D1) of the stepped portion 30 may be even larger than the inner diameter (ID) of the core 50 and the chuck 10 can still be inserted into the core 50. In such instances the axial force of inserting the chuck 10 and, in particular, the stepped portion 30 into the core 50 will outwardly compress the core 50 in the radial dimension, decreasing the core's thickness—assuming the outer diameter (OD) of the core 50 is kept constant by the compressive forces of the wound material—and increasing the inner diameter (ID) of the core 50 up to about 0.1 mm to accommodate the larger diameter stepped portion 30 of the chuck 10.

Figure 3:
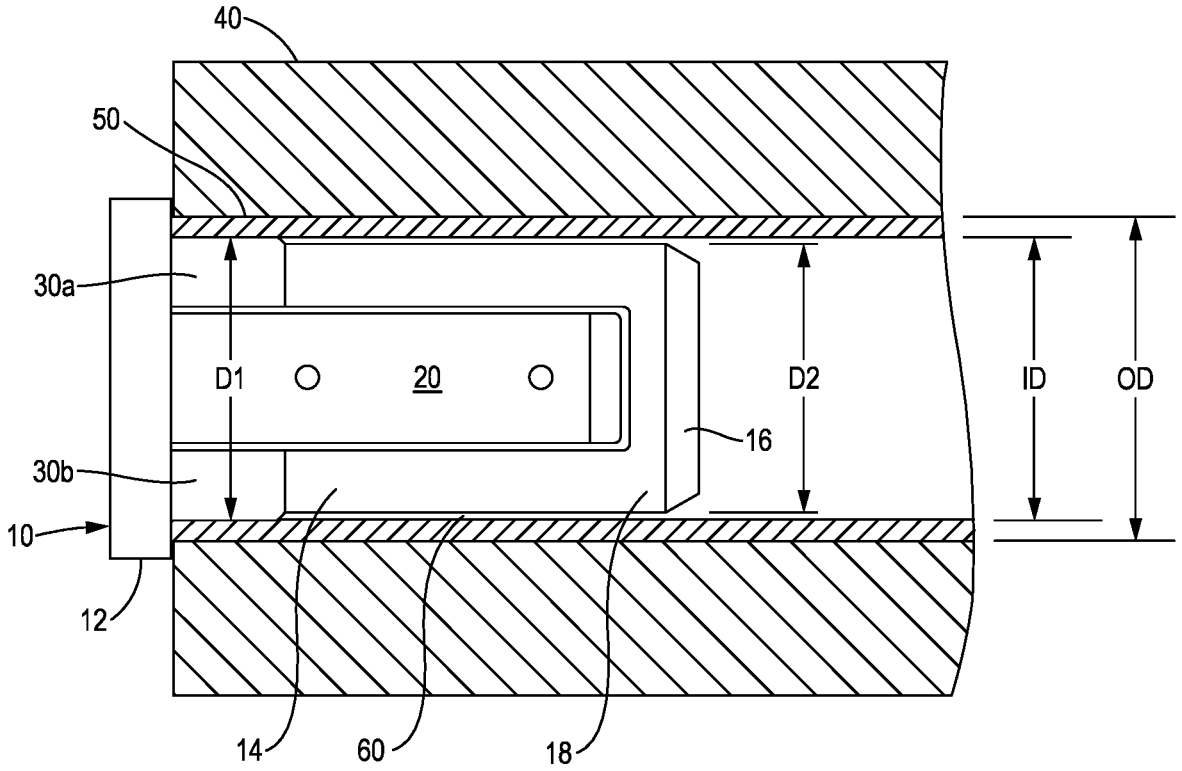
FIG. 3 is a side view of the chuck of FIG. 1 shown with a roll of wound material.

FIG. 3 is a side view of the chuck 10 of FIG. 1 shown inserted into an end of a core 50 that is holding wound material 40. Only the core 50 and wound material 40 are shown in cross-section. The chuck 10 is shown rotated about 45 degrees from the view shown in FIG. 1.

The chuck 10 comprises a flange 12, a body 14, end cap 16 and expansion elements or jaws 20. The jaws 20 may be expanded outwardly to grip the inner surface 52 of the core 50. Only one jaw 20 is shown in FIG. 3.

There is a gap 60 between the inner surface 52 of the core 50 and the distal portion 18 of the chuck body 14 which is large enough to allow insertion of the chuck 10.

The chuck 10 further comprises a stepped portion 30. The stepped portion 30 is divided into individual segments circumferentially disposed around the chuck 10. Two segments 30*a*, 30*b* are shown. The stepped portions 30 contact the core inner surface 52 and center the chuck 10 inside the core 50. In fact, before the jaws 20 are expanded, preferably the only part of the chuck 10 that contacts the inner surface 52 of the core 50 are the stepped portions 30. The overall diameter (D1) of the one or more stepped portions (30) may be equal to the inner diameter (ID) of the core 50.

Method of Holding a Hollow Core While Centering the Chucks

Figure 4:
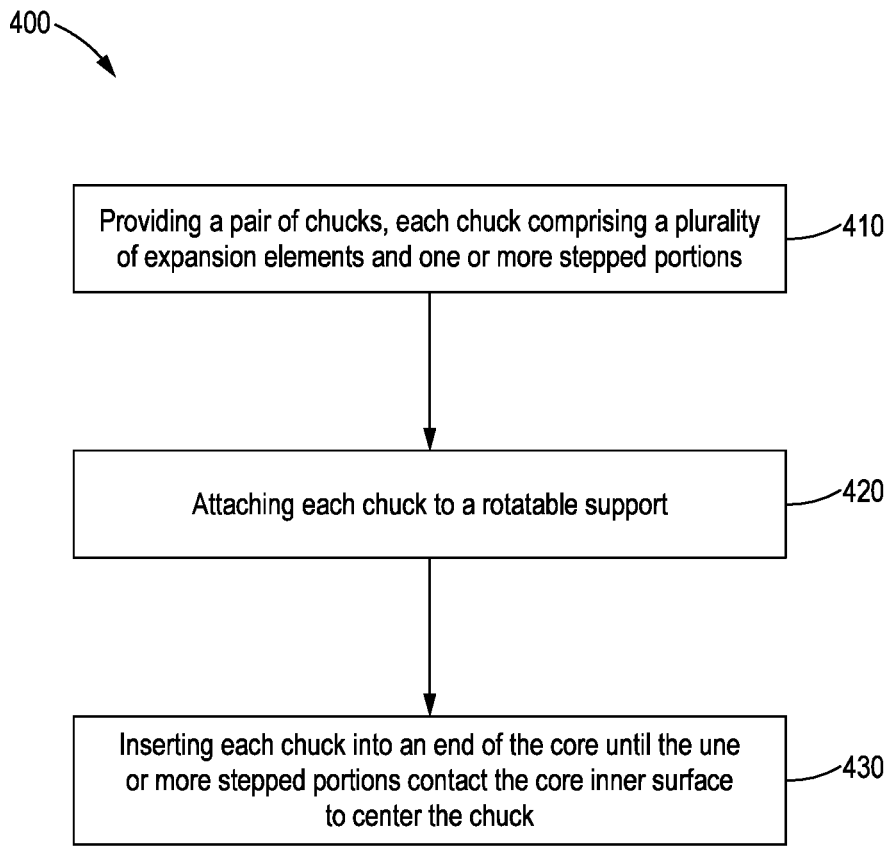
FIG. 4 is a flowchart illustrating a method of holding a hollow core according to the disclosure.

This disclosure also relates to a method of holding a hollow core 50 while centering the chucks 10 within the core 50. Referring to FIG. 4, a pair of chucks 10, each having expansion elements 20 and a stepped portion or portions 30, is provided according to this disclosure. Each of the pair of chucks 10 may be attached to a rotating support. Then, while the expansion elements 20 are in their unexpanded position, each chuck 10 is inserted into an end of the core 50 until the one or more stepped portions 30 contact the core inner surface 52. In this way, the chucks 10 will be centered inside the core 50. Put another way, the rotational axis of the core 50 will be co-linear with the rotational axis of each chuck 10. Each chuck 10 may be inserted until the one or more stepped portions 30 contact the inner surface 52 of the core 50 along an axial distance of less than 30 mm or even less than 20 mm.

After the chucks 10 are inserted into the core 50 and the stepped portions 30 engage the inner surface 52 of the core 50, the expansion elements 20 can be moved radially outward until each expansion element 20 contacts the inner surface 52 of the core 50, further stabilizing the core 50.

Method of Centering a Chuck Within a Hollow Core

This disclosure also relates to a method of centering a chuck 10 within a hollow core 50. A chuck 10 may be centered within a hollow core 50 by attaching the chuck 10 to a support and then inserting the chuck 10 into an end of the core 50 until the one or more stepped portions 30 contact the core inner surface 52. The chuck 10 should be inserted into the end of the core 50 while the expansion elements 20 are in their unexpanded position.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A chuck for receiving a hollow cylindrical core used for winding and unwinding a sheet of material, the core having a core inner diameter and a core outer diameter, the chuck defining an axis and comprising:

a flange adapted to attach the chuck to a rotating support;

a body extending axially from the flange, the body comprising one or more stepped portions near the flange and a distal portion farther away from the flange, the distal portion having a distal portion diameter that is less than the core inner diameter, the distal portion and the core defining a gap therebetween when the core is mounted onto the chuck, the body defining a plurality of recesses; and a plurality of expansion elements circumferentially disposed around the body and adapted to grip an inner surface of the core, each expansion element nested within one of the recesses having a core contacting surface; wherein the one or more stepped portions have a stepped portion diameter that increases from a first stepped portion diameter that is less than the core inner diameter to a second stepped portion diameter that is greater than or equal to the core inner diameter as the stepped portion extends from the distal portion toward the flange;

the one or more stepped portions are configured to contact the core inner surface and center the chuck inside the core when the core is mounted onto the chuck; and the expansion elements are moveable between an unexpanded position in which each of the expansion elements is disposed within one of the plurality of recesses and an expanded position in which each of the expansion elements is located radially outward of its unexpanded position and in which the core contacting surface contacts the inner surface of the core.

2. The chuck of claim 1 wherein:

the one or more stepped portions have an axial length equal to or less than 30 mm.

3. The chuck of claim 1 wherein:

the one or more stepped portions have an axial length equal to or less than 20 mm.

4. The chuck of claim 1 wherein:

the first stepped portion diameter of the one or more stepped portions is equal to the distal portion diameter of the distal portion.

5. The chuck of claim 1 wherein:

the second stepped portion diameter of the one or more stepped portions is greater than the core inner diameter of the core.

6. The chuck of claim 1 wherein:

the expansion elements move radially outward from the unexpanded position and into contact with the core inner surface of the core after the chuck is inserted into the core and the one or more stepped portions contact the core inner surface of the core.

7. The chuck of claim 6 wherein:

the expansion elements move from the unexpanded position to the expanded position as a result of an application of torque on the expansion elements caused by rotation of the chuck.

8. The chuck of claim 1 wherein the distal portion terminates in a distal end, the chuck further comprising:

an end cap extending from the distal end and tapered to facilitate easier mounting of the core onto the chuck.

9. The chuck of claim 1 wherein the one or more stepped portions comprises a plurality of segments circumferentially disposed around the chuck.

10. The chuck of claim 1 wherein the one or more stepped portions comprises a single continuous structure extending circumferentially around the entire chuck.

11. A method of holding a hollow core of the type used for winding and unwinding a wound material, the core having a core inner diameter, the method comprising the steps of:

providing a pair of chucks, each chuck comprising a flange, a body extending axially from the flange and a plurality of expansion elements circumferentially disposed around the body, the body comprising one or more stepped portions near the flange and a distal portion farther away from the flange, the distal portion having a distal portion diameter that is less than the core inner diameter, the distal portion and the core defining a gap therebetween when the core is mounted onto the chuck, the one or more stepped portions having a stepped portion diameter that increases from a first stepped portion diameter that is less than the core inner diameter to a second stepped portion diameter that is greater than or equal to the core inner diameter as the stepped portion extends from the distal portion toward the flange, and the expansion elements being moveable between an unexpanded position in which each of the expansion elements is disposed within one of the plurality of recesses defined by the body and an expanded position in which each of the expansion elements is located radially outward of its unexpanded position;

attaching each chuck to a rotating support; and inserting each chuck into an end of the core until the one or more stepped portions contact the core inner surface and center the chuck inside the core, wherein each chuck being inserted while the expansion elements are in their unexpanded position.

12. The method of claim 11 comprising the additional step of:

moving the expansion elements radially outward until a core contacting surface of each expansion element contacts the inner surface of the core.

13. The method of claim 11 wherein:

the expansion elements move from the unexpanded position to the expanded position as a result of an application of torque on the expansion elements caused by rotation of the chuck.

14. The method of claim 11 wherein:

during the inserting step, each chuck is inserted until the one or more stepped portions contact the inner surface of the core along an axial distance of less than 30 mm.

15. The method of claim 11 wherein:

during the inserting step, each chuck is inserted until the one or more stepped portions contact the inner surface of the core along an axial distance of less than 20 mm.

16. The method of claim 11 wherein:

the first stepped portion diameter of the one or more stepped portions is equal to the distal portion diameter of the distal portion.

17. The method of claim 11 wherein:

the second stepped portion diameter of the one or more stepped portions is greater than the core inner diameter of the core.

18. A method of centering a chuck within a hollow core, the core having a core inner diameter, the method comprising the steps of:

providing a chuck comprising a flange, a body extending axially from the flange and a plurality of expansion elements circumferentially disposed around the chuck, the body comprising one or more stepped portions near the flange and a distal portion farther away from the flange, the distal portion having a distal portion diameter that is less than the core inner diameter, the distal portion and the core defining a gap therebetween when the core is mounted onto the chuck, the one or more stepped portions having a stepped portion diameter that increases from a first stepped portion diameter that is less than the core inner diameter to a second stepped portion diameter that is greater than or equal to the core inner diameter as the stepped portion extends from the distal portion toward the flange, and the expansion elements being moveable between an unexpanded position in which each of the expansion elements is disposed within one of the plurality of recesses defined by the body and an expanded position in which each of the expansion elements is located radially outward of its unexpanded position;

attaching the chuck to a support; and inserting the chuck into an end of the core until the one or more stepped portions contact the core inner surface, wherein the chuck is inserted into the end of the core while the expansion elements are in their unexpanded position.

19. The method of claim 18 wherein:

the first stepped portion diameter of the one or more stepped portions is equal to the distal portion diameter of the distal portion.

20. The method of claim 18 wherein:

the second stepped portion diameter of the one or more stepped portions is greater than the core inner diameter of the core.

* * * * *